United States Patent [19]

Minn

[11] Patent Number: 4,565,947

[45] Date of Patent: Jan. 21, 1986

[54] COLOR CATHODE RAY TUBE FOR USE WITH A LIGHT PEN

[75] Inventor: Andre B. Minn, Woodstock, N.Y.

[73] Assignee: International Business Machines Corporation, Armonk, N.Y.

[21] Appl. No.: 588,425

[22] Filed: Mar. 12, 1984

[51] Int. Cl.[4] ..... H01J 29/20; H01J 29/32

[52] U.S. Cl. ..... 313/467; 313/472; 313/474; 340/707

[58] Field of Search ..... 313/467, 468, 472, 474, 313/471; 340/707, 708

[56] References Cited

U.S. PATENT DOCUMENTS 2,687,360 8/1954 Michaels ..... 313/472 X
4,424,467 1/1984 Masuda et al. ..... 313/467
4,459,476 7/1984 Weissmueller ..... 340/365 P X
4,496,158 1/1985 Baer ..... 340/707 X

FOREIGN PATENT DOCUMENTS 2118362 10/1983 United Kingdom ..... 313/468

*Primary Examiner*—Palmer C. DeMeo
*Attorney, Agent, or Firm*—Frederick D. Poag

[57] ABSTRACT

In a shadow mask cathode ray tube for use with a light pen, the elemental phosphor areas emissive of red light comprise a blend of a red-emissive phosphor with silver-activated cadmium sulphide (CdS:Ag), the CdS:Ag being present in an amount from 10% to 30% by weight of the blend. In the preferred embodiment the blend comprises approximately 20% by weight of CdS:Ag and 80% by weight of industry standard P22R phosphor.

6 Claims, 2 Drawing Figures

COLOR CATHODE RAY TUBE FOR USE WITH A LIGHT PEN

FIELD OF THE INVENTION

This invention relates to a shadow mask cathode ray tube (CRT) for use with a light pen.

BACKGROUND OF THE INVENTION

As is well known, a shadow mask CRT is a color reproducing cathode-ray tube of the kind comprising, within an evacuated envelope, an image screen provided with a plurality of groups of elemental phosphor areas, the groups of phosphor areas being emissive of red, green and blue light respectively and being interspersed so as to form repetitive clusters of areas including one area from each group, electron gun means for projecting a corresponding plurality of electron beams toward the image screen, deflection means for causing the electron beams to scan the image screen in synchronism, and a mask (the shadow mask) disposed adjacent the screen between the latter and the electron gun means and having a plurality of apertures so arranged as to constrain each beam to strike the elemental phosphor areas of only one respective group.

Shadow mask CRTs have long been used in the field of domestic color television, and their construction and operation is very well known to those skilled in the art. One example of a typical shadow mask CRT is described in U.S. Pat. No. 3,146,368.

Although U.S. Pat. No. 3,146,368 describes a construction of shadow mask CRT in which the elemental phosphor areas are in the form of circular dots clustered in triads of red, green and blue light-emitting phosphors, these areas may take other shapes with a corresponding shape of the apertures in the shadow mask. Thus, the elemental phosphor areas may be in the form of clusters of rectangles, hexagons or other geometric shapes.

Furthermore, a recent and now well-established form of shadow mask tube uses narrow vertical phosphor stripes each of which extends the full height of the image screen. In this case, each cluster of elemental phosphor areas constitutes a set of red, green and blue vertical phosphor stripes and the corresponding shadow mask (alternatively referred to as an aperture grill in this type of tube) comprises a large number of vertical slits also extending the full height of the screen. A shadow mask CRT of the latter type is referred to in U.S. Pat. No. 3,666,462, particularly with reference to FIG. 5. In either case the image screen may comprise the inside surface of the CRT faceplate itself, or a separate transparent support behind the faceplate.

In the aforementioned U.S. Pat. No. 3,146,368, each of the elemental phosphor areas is spaced on the image screen from all adjacent such areas and the apertures in the shadow mask are individually larger than the elemental phosphor areas so that each beam striking any given elemental phosphor area additionally falls on a portion of the screen which spaces that area from adjacent areas. In particular, a negative tolerance guard band arrangement is described in which circular phosphor dots are used and the electron beam not only falls upon the dot in any given case, but also upon an annular portion of the screen immediately surrounding the dot, a black light-absorbing material known as a black matrix being provided over substantially the entire area of the screen not occupied by the phosphor dots.

The advantage of this arrangement is that the black matrix intermediate the dots absorbs ambient light and increases the contrast of the image. The negative tolerance guard band black matrix technique has also been applied to the aperture grill type of shadow mask CRT, see for example, U.S. Pat. No. 4,267,204, with the vertical slits in the grill being wider than the phosphor stripes and the latter being separated from the adjacent stripes by intermediate stripes of light-absorbing material. In this case the electron beam passing through any given aperture falls substantially centrally on the relevant phosphor stripe with the opposite lateral edges of the beam falling on the light-absorbing material on either side. In modern shadow mask CRTs the light-absorbing material or black matrix comprises graphite of sub-micron particle size.

The long-established development of shadow mask tubes such as those described in U.S. Pat. Nos. 3,146,368 and 3,666,462 for domestic television, with their consequent high reliability and relatively low cost, has led to their use as video display units in multi-color computer graphics applications. Essentially, the shadow mask tubes used in computer graphics are the same as those used in domestic television, except that for high resolution graphics both the number of individual elemental phosphor areas on the image screen and the precision of the deflection circuitry is increased as compared to the domestic tube. Nevertheless, whether the tube is for high resolution graphics or low resolution graphics (in which case a domestic-grade tube can be used), the fundamental principles of construction and operation are well known.

A common requirement in interactive computer graphics is the ability to provide user feedback by the use of a so-called light pen which contains a photosensitive device responsive to light emitted by the CRT display for providing a feedback signal to the display control unit. It is important in such applications that the light pen reliably "triggers" in response to any light emissive portion of the displayed image at which the pen is pointed at any given time.

The light pen may employ a PIN diode for high sensitivity, and in order to trigger such a light pen reliably it is necessary that the phosphors employed on the screen have a fast transient (rise time). This is a particular problem for the red phosphor, since when the color graphics display is capable of displaying over one million picture elements on a 20" diagonal screen, even the widely used industry standard rare earth type P22R red phosphor is not fast enough to activate the highly sensitive PIN diode.

SUMMARY OF THE INVENTION

It is therefore an object of the present invention to provide an improved shadow mask CRT for use with a light pen.

Accordingly, in a shadow mask cathode ray tube for use with a light pen, the invention provides the improvement wherein the elemental phosphor areas emissive of red light comprise a blend of a red-emissive phosphor with silver-activated cadmium sulphide (CdS:Ag), the CdS:Ag being present in an amount from 10% to 30% by weight of the blend.

It is to be understood that the term "shadow mask cathode ray tube" includes not only the conventional type wherein the phosphors are arranged in triads of red, green and blue dots, but also the aperture grill type of tube wherein the phosphors are arranged in stripes.

For tubes operating at a refresh rate of about 60 Hz or greater it is preferred that the basic red phosphor with which the CdS:Ag is blended is the industry standard phosphor P22R ($Y_2O_2S$:Eu or $Y_2O_2S$:Eu/$Fe_2O_3$). However, for tubes which operate at a refresh rate significantly less than this it is preferred to use a mixture of P22R and P27 as the red phosphor, since the relatively low persistence of P22R may provide unacceptable flicker when used alone at lower refresh rates. For example, for a 50 Hz tube it is preferred to use equal parts by weight of P22R and P27 as the basic red phosphor with which the CdS:Ag is blended in the above amount.

As will be described, the addition of the CdS:Ag to the red phosphor increases the radiant sensitivity of the phosphor (which determines the light pen triggering capability), while reducing its luminance efficiency (brightness). The range of 10% to 30% is therefore chosen as a trade-off between these two effects. For the preferred blend of 80% P22R with 20% CdS:Ag the radiant sensitivity is more than doubled with the sacrifice of about 10% loss of luminance efficiency. As we will show, the doubling of the radiant sensitivity translates to a performance improvement of more than 140 times relative to P22R alone for light pen triggering, using a particular type of PIN diode photodetector in the light pen. It is also possible to compensate for the reduction of brightness of the blended phosphor by increasing the size of the red phosphor dots or stripes relative to the green and blue.

It is to be noted that silver-activated zinc cadmium sulphide (ZnCdS:Ag) was proposed as a red phosphor some 20 years ago for radar applications, and in commercial televisions. However, it was never widely used due to its low efficiency in the visible red part of the spectrum (600–700nm), and rapidly fell into disuse. Also CdS:Ag per se was used in dielectric-cell bolometers for infra-red signalling. However, so far as we are aware, it was never mixed with other phosphors nor used in color tubes. The only use of CdS in a color tube of which we are aware is described in our co-pending application Ser. No. 495,882 entitled "Color Cathode Ray Tube", filed on May 18, 1983. However, in that case the CdS is mixed with the black matrix of the screen and not with the visible red phosphor. Furthermore, CdS used is activated with copper (CdS:Cu) which is a solely infra-red phosphor and has no significant output in the visible red region (600 nm to 700 nm).

The advantage of the CdS:Ag used in the invention is that, while it peaks in the infra-red (at about 730 nm–740 nm), it nevertheless has a significant output in the visible red region of the spectrum and therefore does not reduce the brightness of the blended red phosphor to an unacceptable extent.

BRIEF DESCRIPTION OF THE DRAWINGS

The invention will be better understood from the following description of an embodiment thereof, given by way of example only, with reference to the accompanying drawings, in which.

DETAILED DESCRIPTION OF THE INVENTION

Figures 1, 2:
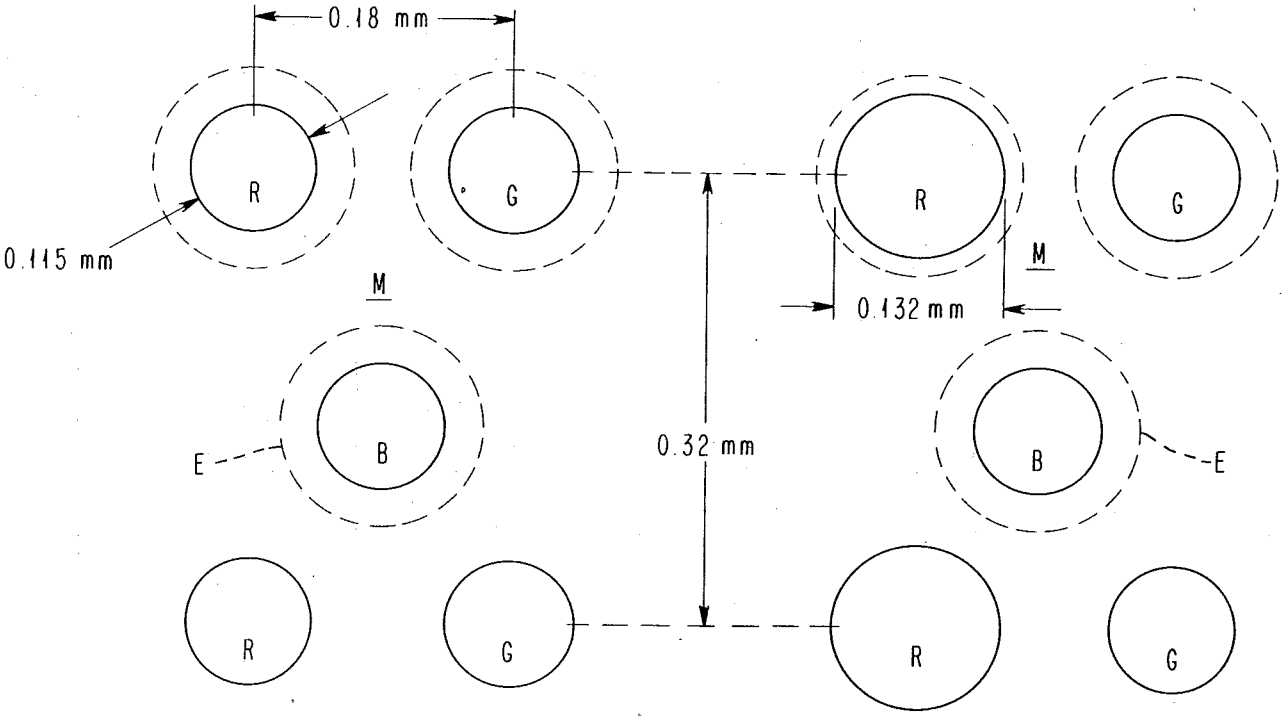
FIG. 1 illustrates a conventional geometrical arrangement of red, green and blue phosphor dots on a CRT screen.
FIG. 2 illustrates the geometrical arrangement of the phosphor dots on the CRT screen to compensate for the loss of brightness resulting from use of the present invention.

The preferred embodiment of the blended red phosphor comprises 80% by weight of P22R and 20% by weight of CdS:Ag. This blended phosphor can readily be produced by those skilled in the art, as both of the component materials are known and techniques for blending different phosphors are well known. For a high resolution graphics CRT monitor it is preferred that the median particle size of both the P22R and CdS:Ag in the blend be about 9 microns or less.

The luminance efficiency of P22R is typically 12 lumens per absorbed watt. The equivalent luminance efficiency of CdS:Ag is only 4 lm/watt. However, the radiant sensitivity—the total radiant (watts) output for a given brightness—of P22R is only 1.9 uwatts/Nit as compared with 12.2 uwatts/Nit for CdS:Ag. Therefore, by mixing 80% of P22R with 20% CdS:Ag the radiant sensitivity is more than doubled at the sacrifice of only 10% loss of luminance efficiency.

This blended phosphor has the following optical characteristics:

Chromaticity: The trichromatic coefficients are X=0.683 and Y=0.315, referring to the standard CIE chromaticity diagram.

Persistence: 70 usecs (measured at 10% of the peak luminance efficiency at 12 KV anode bias and 2 uamps/in$^2$).

Luminance efficiency: 11 lm/watt (projected from the published efficiency of P22R).

Radiant sensitivity: 4.02 uwatts/Nit.

The performance of the blended phosphor with respect to light pen activation will now be compared with the conventional P22R phosphor.

In general, the instantaneous peak brightness and temporally averaged brightness of a screen can be related to refresh rate and 10% decay persistence. That is, $$\gamma = B_o/B_a = 1/(2Rt)$$

where $B_o$=Peak brightness, $B_a$=Average brightness,

R=Screen refresh rate in Hz, and t=Decay time (persistence) to 10% of peak in seconds.

The $\gamma$ of each phosphor can be computed from known persistence values, and assuming the refresh rate is 60 Hz:

P22R:$\gamma$=16.83; CdS:Ag:$\gamma$=555.6

If we assume that the light pen photodetector is a Litronix type BPW34 PIN diode whose spectral sensitivity is 0.6 amps/watt, the average available current at the photodiode for a given brightness can be calculated by multiplying the phosphor radiant output sensitivity with the photodiode spectral sensitivity at a given peak wavelength. The available peak current at the photodiode is then found by multiplication of the peak to average brightness ratio with the average available current at the photodiode for a given brightness. Typical results at normal brightness levels for the conventional and blended phosphors are as follows:

P22R: Available peak current=14.26 uAmp.

Blended red: Available peak current=1990.7 uAmp.

Thus, the performance of the conventional red phosphor for light pen applications is improved by a factor of over 140 by blending with the CdS:Ag.

For the particular photodetector referred to above we found that the conventional P22B blue phosphor was adequate to trigger the light pen, as was a mixture of equal parts by weight of P22G and P31G green phosphors. These were therefore suitable respectively as the phosphors for the blue and green elemental phosphor areas of the shadow mask tube, the red elemental phosphor areas being the new P22R/CdS:Ag blend described above.

The preferred form of shadow mask CRT in which the above phosphor compositions are used is the black matrix type referred to earlier. The manufacture of such a tube may be performed entirely conventionally if the 10% loss in brightness is acceptable, except that the blended phosphor according to the invention is used for the red areas rather than the standard P22R or other red-emissive phosphor, and the mixed P22G and P31G is used for the green areas.

However, to overcome the 10% loss in brightness which occurs by blending the CdS:Ag with the P22R it is advantageous to increase the area of the red phosphor dots or stripes relative to the green and blue dots or stripes. This can be achieved by a simple modification of the conventional technique used for black matrix screen manufacture.

In the conventional technique, clear unpigmented polyvinyl alcohol (PVA) is deposited on the CRT screen and exposed in a light house from all three color center positions through the shadow mask to be used with that screen (actually, at this stage, the apertures in the shadow mask are slightly smaller than their ultimate size, and are only increased to their final size for exposure of the color phosphors during formation of the elemental areas). After development of the PVA, the screen has a system of clear dots (or stripes, depending on tube type) which correspond to positions in the black matrix subsequently to be occupied by the elemental phosphor areas. The black matrix is next formed around the dots (or stripes) which are then removed, leaving apertures in the black matrix where the color phosphors are to be located. The red, green and blue phosphor areas are finally formed selectively in their respective apertures in the black matrix in three separate deposition and exposure operations, in known manner.

The apertures in the black matrix define the sizes of the elemental phosphor areas, and typical dimensions are shown in FIG. 1 for the conventional technique where the dots are nominally all the same size. In FIG. 1, R, G and B represent the red, green and blue phosphor dots respectively, M represents the black matrix in which the dots are embedded, and E represents the electron beam diameter after passing through the shadow mask.

In the above described process, the intensity profile of the light falling on the PVA through each shadow mask aperture is not constant but is dependent on the size of the light source and also on light diffraction at the edges of these apertures, with the result that the PVA dot size (or stripe width) d is (within limits) linearly proportional to the exposure E. Thus, $$E=k_1.T.I$$

and $$d=k_2.E$$

where

T=exposure time,

I=illumination intensity, and $k_1,k_2$ are constants.

Thus I and T are carefully controlled to provide the correct size of dot, which in the conventional process is the same for all three of the color phosphors.

In the modification of the above process to provide red phosphor dots which are larger than the green and blue dots, the exposure E of the PVA, as determined by the product of T and I, is increased for the red dot locations as compared to the exposure for the green and blue dot locations. In the particular process which we used, the exposure was increased by 15% resulting in the red dots R having an increased diameter of 0.132 mm compared to their former diameter of 0.115 mm; see FIG. 2.

The same considerations apply to the aperture grill type of shadow mask CRT, so that by selectively increasing the exposure of the PVA for the red stripe locations the width of these may also be increased relative to the widths of the green and blue stripe locations.

For the example shown in FIG. 2, the brightness of the red is increased by about 23% over FIG. 1, since brightness is proportional to the square of the dot diameter. For a similar increase in width (from 0.115 mm to 0.132 mm) of the red phosphor stripes in an aperture grill type tube, the brightness of the red is increased by 15% only, since in that case the brightness is directly proportional to the width of the phosphor stripes.

Since an increase in the size of the red phosphor dots or stripes may, in itself, cause errors in purity, if such errors are unacceptable the size of the green and blue dots or stripes may be reduced to preserve the purity of the image; for example, by reducing the size of each from 0.115 mm to 0.105 mm. This reduction in size may similarly be achieved by suitably controlling the exposure of the green and blue dot or stripe locations in the light source, in particular by reducing the total exposure E.

In the above photolithographic process, whether used for producing a screen with equal-sized elemental phosphor areas or a screen in which the red areas are larger than the green and blue areas, it is preferable in order to obtain accurate placement of the phosphor dots to use the technique described in U.S. Pat. No. 3,628,850, wherein exposure in the light house is performed with a segmented correction lens rather than with a continuous lens. Further details of this technique are not given here as they are adequately described in the abovementioned U.S. Pat. No. 3,628,850.

While the invention has been particularly shown and described with reference to a preferred embodiment thereof, it will be understood by those skilled in the art that various changes in form and detail may be made therein without departing from the spirit and scope of the invention.

I claim:

1. In a shadow mask cathode ray tube for use with a light pen, the improvement wherein the elemental phosphor areas emissive of red light comprise a blend of a red-emissive phosphor with silver-activated cadmium sulphide (CdS:Ag), the CdS:Ag being present in an amount from 10% to 30% by weight of the blend.

2. A shadow mask cathode ray tube according to claim 1, wherein the blend comprises approximately 20% by weight of CdS:Ag.

3. A shadow mask cathode ray tube according to claim 1, wherein the red-emissive phosphor comprises P22R phosphor.

4. A shadow mask cathode ray tube according to claim 2, wherein the red-emissive phosphor comprises P22R phosphor.

5. A shadow mask cathode ray tube according to any preceding claim wherein the cathode ray tube is of the black matrix type.

6. A shadow mask cathode ray tube according to claim 5, wherein the size of the elemental phosphor areas emissive of red light is greater than than of the elemental phosphor areas emissive of green and blue light.

* * * * *